US010208427B2

(12) United States Patent
Sierra et al.

(10) Patent No.: US 10,208,427 B2
(45) Date of Patent: Feb. 19, 2019

(54) PATTERNED TISSUE PRODUCT

(71) Applicant: Kimberly-Clark Worldwide, Inc., Neenah, WI (US)

(72) Inventors: Benjamin Peter Sierra, Appleton, WI (US); Lisa Maria Kocourek, Brillion, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 15/759,021

(22) PCT Filed: Jul. 25, 2017

(86) PCT No.: PCT/US2017/043672
§ 371 (c)(1),
(2) Date: Mar. 9, 2018

(87) PCT Pub. No.: WO2018/022587
PCT Pub. Date: Feb. 1, 2018

(65) Prior Publication Data

US 2018/0363244 A1 Dec. 20, 2018

Related U.S. Application Data

(60) Provisional application No. 62/368,264, filed on Jul. 29, 2016.

(51) Int. Cl.

| | |
|---|---|
| ***B31F 1/07*** | (2006.01) |
| ***D21F 11/00*** | (2006.01) |
| ***D21H 27/02*** | (2006.01) |
| *A47K 10/16* | (2006.01) |
| *D21H 27/00* | (2006.01) |

(52) U.S. Cl.
CPC ..... *D21F 11/006* (2013.01); *B31F 1/07* (2013.01); *D21H 27/02* (2013.01); *A47K 10/16* (2013.01); *B31F 2201/0735* (2013.01); *D21H 27/002* (2013.01)

(58) Field of Classification Search
CPC .... D21H 27/02; D21H 27/002; D21F 11/006; B31F 1/07; B31F 2201/0733; A47K 10/16
See application file for complete search history.

(56) References Cited

U.S. PATENT DOCUMENTS

| | | | |
|---|---|---|---|
| D29,723 | S | 11/1898 | Lowe |
| D40,194 | S | 7/1909 | Bright |

(Continued)

FOREIGN PATENT DOCUMENTS

| | | | |
|---|---|---|---|
| CN | 102715862 | A | 10/2012 |
| DM | 063266 | | 5/2003 |

(Continued)

*Primary Examiner* — Jose A Fortuna
(74) *Attorney, Agent, or Firm* — Kimberly-Clark Worldwide, Inc.

(57) ABSTRACT

The present invention provides a patterned tissue product comprising a first surface with a first and a second pattern disposed thereon, the first pattern comprising a curvilinear design element having a first maximum segment length and the second pattern comprising a curvilinear design element having a second maximum segment length wherein the second maximum segment length is from about 50 to about 150 percent of the first maximum segment length.

6 Claims, 7 Drawing Sheets

(56) References Cited

U.S. PATENT DOCUMENTS

D41,047 S 12/1910 Hacker
D51,320 S 10/1917 Nathan
D104,352 S 5/1937 Minoff
D105,784 S 8/1937 Zavell
D116,385 S 8/1939 Sigoda
D117,997 S 12/1939 Kaplan
D136,444 S 10/1943 Allen
D166,543 S 4/1952 Laska
3,047,292 A 7/1962 Pietro
D240,563 S 7/1976 Whitehead et al.
D242,579 S 11/1976 Walbrun
D247,371 S 2/1978 Whitehead
D274,362 S 6/1984 Whitehead
D276,282 S 11/1984 Burg
4,781,966 A 11/1988 Taylor
D341,944 S 12/1993 Peter
5,336,545 A 8/1994 Morman
D356,918 S 4/1995 Marshburn
D360,531 S 7/1995 Griffith
D370,566 S 6/1996 Koster et al.
5,597,639 A 1/1997 Schulz et al.
D421,528 S 3/2000 Shakora
D488,622 S 4/2004 Dwiggins
D509,366 S 9/2005 Pommier et al.
D524,552 S 7/2006 Delaney et al.
D525,435 S 7/2006 Delaney et al.
D528,307 S 9/2006 Pommier et al.
D572,489 S 7/2008 Ko et al.
D581,677 S 12/2008 Yeh
D611,255 S 3/2010 Ko et al.
D612,156 S 3/2010 Barredo et al.
D618,919 S 7/2010 Catalfamo et al.
7,771,648 B2 8/2010 Sheehan et al.
D632,498 S 2/2011 Vidal et al.
D634,552 S 3/2011 Bischoff et al.
D636,607 S 4/2011 Withers
D638,224 S 5/2011 Ko et al.
D645,258 S 9/2011 Weber
D650,994 S 12/2011 Sheehan et al.
D652,632 S 1/2012 Vitucci et al.
D653,779 S 2/2012 Damen et al.
D663,126 S 7/2012 Lapinid, Jr. et al.
8,287,986 B2 10/2012 Huss et al.
D672,154 S 12/2012 Huss et al.
D672,564 S 12/2012 Sheehan et al.
D674,612 S 1/2013 Sarbo et al.
D695,552 S 12/2013 Gatto
8,753,751 B1 6/2014 Hermans et al.
D716,057 S * 10/2014 Burazin ..... D5/59
D718,537 S 12/2014 Seitzinger et al.
D719,742 S 12/2014 Seitzinger et al.
9,206,555 B2 12/2015 Hermans et al.
9,315,945 B2 4/2016 Maladen et al.
D757,450 S * 5/2016 Sierra ..... D5/53
2007/0272381 A1 11/2007 Elony et al.
2009/0056891 A1 3/2009 Wiwi et al.
2009/0155512 A1 6/2009 Neto et al.
2009/0297781 A1 12/2009 Huss et al.
2010/0314058 A1* 12/2010 Hupp ..... D21H 27/002 162/109
2011/0083819 A1 4/2011 Nozaki et al.
2012/0034430 A1* 2/2012 Nelson ..... D21H 27/002 428/195.1
2012/0088076 A1 4/2012 Glakpe et al.
2012/0118519 A1 5/2012 Hutchison
2013/0048239 A1 2/2013 Fung et al.
2013/0143001 A1* 6/2013 Manifold ..... D06C 23/04 428/167
2013/0319625 A1 12/2013 Mohammadi et al.
2013/0327487 A1 12/2013 Espinosa et al.
2014/0134374 A1* 5/2014 Chu ..... B31F 1/07 428/43
2015/0033027 A1 1/2015 Miller et al.
2015/0101772 A1 4/2015 Olson
2015/0173571 A1 6/2015 Maladen et al.
2015/0176219 A1* 6/2015 Hannen ..... D21H 27/002 162/109
2015/0176220 A1* 6/2015 Ostendorf ..... D21H 27/02 162/111
2015/0176221 A1 6/2015 Maladen et al.
2015/0211187 A1 7/2015 McNeil et al.
2015/0330030 A1* 11/2015 Dwiggins ..... D21H 27/42 162/109
2016/0160439 A1 6/2016 Mohammadi et al.
2017/0226697 A1 8/2017 Ostendorf et al.
2017/0233951 A1 8/2017 Burazin et al.
2018/0112361 A1* 4/2018 Wang ..... D21H 27/02
2018/0142422 A1* 5/2018 Baum ..... D21H 27/02
2018/0216298 A1* 8/2018 Vogt ..... D21H 23/56

FOREIGN PATENT DOCUMENTS

EM EM 001870361-000 1 5/2011
PT 8418-0001 10/2003
WO WO-2018022587 A1 * 2/2018 ..... D21H 27/002

* cited by examiner

PATTERNED TISSUE PRODUCT

BACKGROUND OF THE DISCLOSURE

Patterned tissue products are well known in the art. Patterns are imparted to tissue products for a variety of reasons such as providing the product with a visually pleasing aesthetic or to communicate to a consumer one or more attributes of the product. For example, a pattern may be disposed on the surface of a tissue product to communicate to a consumer that the tissue product is soft or strong. In other instances a pattern may be disposed on a tissue product for the purposes of appearing contemporary or fashionable.

A wide variety of patterns have been used to provide the product with a visually pleasing aesthetic or to communicate to a consumer one or more attributes of the product. For example, patterns have been employed to impart the tissue product with a woven appearance. Such patterns may include intersecting elements that form a continuous network across the tissue product surface. In other instances a tissue product attribute, such as strength, may be communicated to a consumer by providing a grid-like pattern of interlocking elements. In still other instances the tissue product may comprise a pattern having a contemporary design aesthetic such as a geometric shape.

Although patterned tissue products are well known and a wide variety of patterns have been employed, consumers continue to demand visually unique and appealing patterned tissue products. There remains a particular need for a patterned tissue product that can communicate one or more product attributes to a consumer and be visually appealing.

Accordingly, there remains a need for a tissue product having a pattern disposed on its surface, and particularly a pattern that provides consumers with a perception of softness and comfort while also being visually appealing.

SUMMARY OF THE DISCLOSURE

The present invention fulfills the unmet needs of the prior art by providing tissue products having patterns that connote femininity, softness and cleansing. In particular, the inventive tissue products comprise a first pattern having a curvilinear design element and a second pattern having a curvilinear design element where the curvilinear design elements visually relate the patterns to one another. By visually relating the first and second patterns to one another the present inventors not only provide a tissue product that connotes femininity, softness and cleansing, but is also visually appealing.

The first and second patterns may be further related to one another by relating the scale of the patterns. For example, in another embodiment, the present invention provides a tissue product having a first pattern comprising a curvilinear design element having a first shape, such as a wave, with two points of inflection that define a segment length from about 30 to about 60 mm and a second pattern comprising a curvilinear design element having a second shape, such as a bell-shaped curve, with two points of inflection that define a segment length from about 30 to about 60 mm.

In another embodiment the present invention provides a patterned tissue product comprising a first surface with a first and a second pattern disposed thereon, the first pattern comprising a curvilinear design element having a first maximum segment length and the second pattern comprising a curvilinear design element having a second maximum segment length wherein the second maximum segment length is from about 50 to about 150 percent of the first maximum segment length.

In still another embodiment the invention provides a tissue product comprising a surface and a first and a second pattern disposed thereon, the first and the second patterns overlaying one another, the first pattern extending across the surface in a first direction and comprising a curvilinear design element having a first maximum segment length and a second pattern that extends across the surface in a second direction and comprises a curvilinear design element having a second maximum segment length, wherein the first and second directions intersect and the second maximum segment length is from about 50 to about 150 percent of the first maximum segment length.

In another embodiment the invention provides a tissue product comprising a surface and a pattern disposed thereon, the pattern comprising a first continuous pattern that extends across the surface in a first direction and comprises a curvilinear design element having two or more points of inflection and a first maximum segment length, and a second pattern that extends across the surface in a second direction and comprises a discrete curvilinear design element having two or more points of inflection and a second maximum segment length, wherein the first and second directions intersect and the second maximum segment length is from about 50 to about 150 percent of the first maximum segment length.

In still another embodiment the invention provides a method of manufacturing a patterned tissue product comprising the steps of depositing an aqueous suspension of papermaking fibers onto an endless forming fabric to form a wet web; at least partially dewatering the wet web; transferring the partially dewatered web to a through-air drying fabric having a pattern disposed thereon; molding the web to the patterned through-air drying fabric to impart a first pattern on the web; through-air-drying the web; and embossing the through-air-dried web to impart a second pattern on the web, wherein the first pattern comprises a first curvilinear design element having a first maximum segment length and the second pattern comprises a curvilinear design element having a second maximum segment length, wherein the first and second directions intersect and the second maximum segment length is from about 50 to about 150 percent of the first maximum segment length.

DEFINITIONS

As used herein the term "machine direction" or "MD" generally refers to the direction in which a tissue web or product is produced. The term "cross-machine direction" or "CD" refers to the direction perpendicular to the machine direction.

As used herein the term "Line Element" refers to an element in the shape of a line, which may be continuous, discrete, interrupted, or a partial line with respect to a tissue product on which it is present. The line element may be of any suitable shape such as straight, curled, curvilinear, and mixtures thereof. In one example, the line element may comprise a plurality of discrete elements, such as dots, dashes or broken lines for example, that are oriented relative to one another to form a line element having a substantially connected visual appearance.

Figure 3:
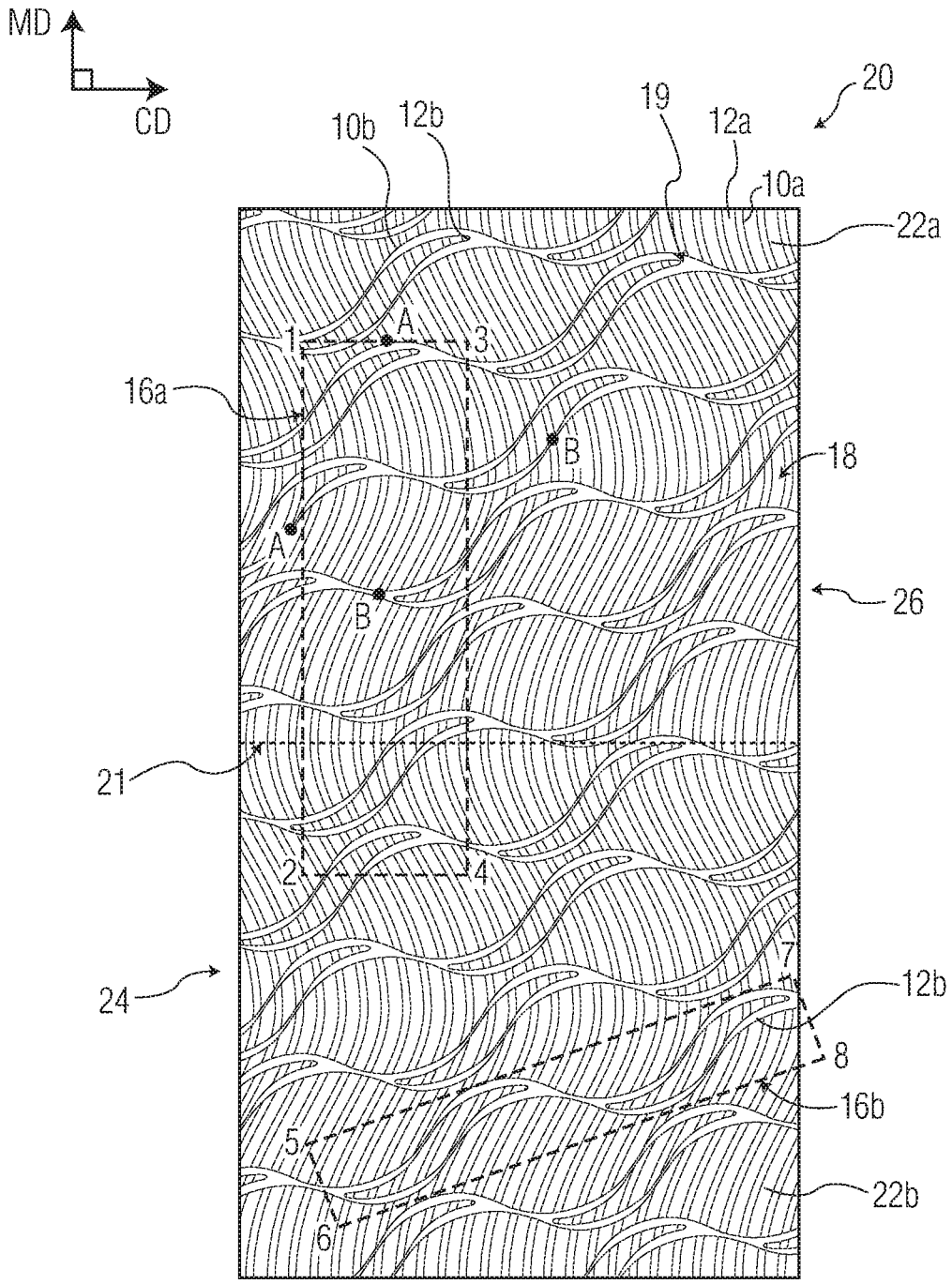
FIG. 3 illustrates a tissue product comprising first and second curvilinear design elements according to one embodiment of the present invention.

As used herein the term "Continuous" when referring to an element disposed on the surface of a tissue product, such as a line element, a design element or a pattern, means that the element extends throughout one dimension of the tissue product surface. A non-limiting example of a continuous pattern is illustrated in FIG. 3 where the first pattern 18 is a continuous pattern in the form of a sinusoidal wave having a first principle direction 37 that is slightly skewed relative to the MD axis 40 by an angle (γ). The first pattern 18 is continuous despite being periodically interrupted by the second pattern 19, which overlays the first pattern 18.

Figure 4:
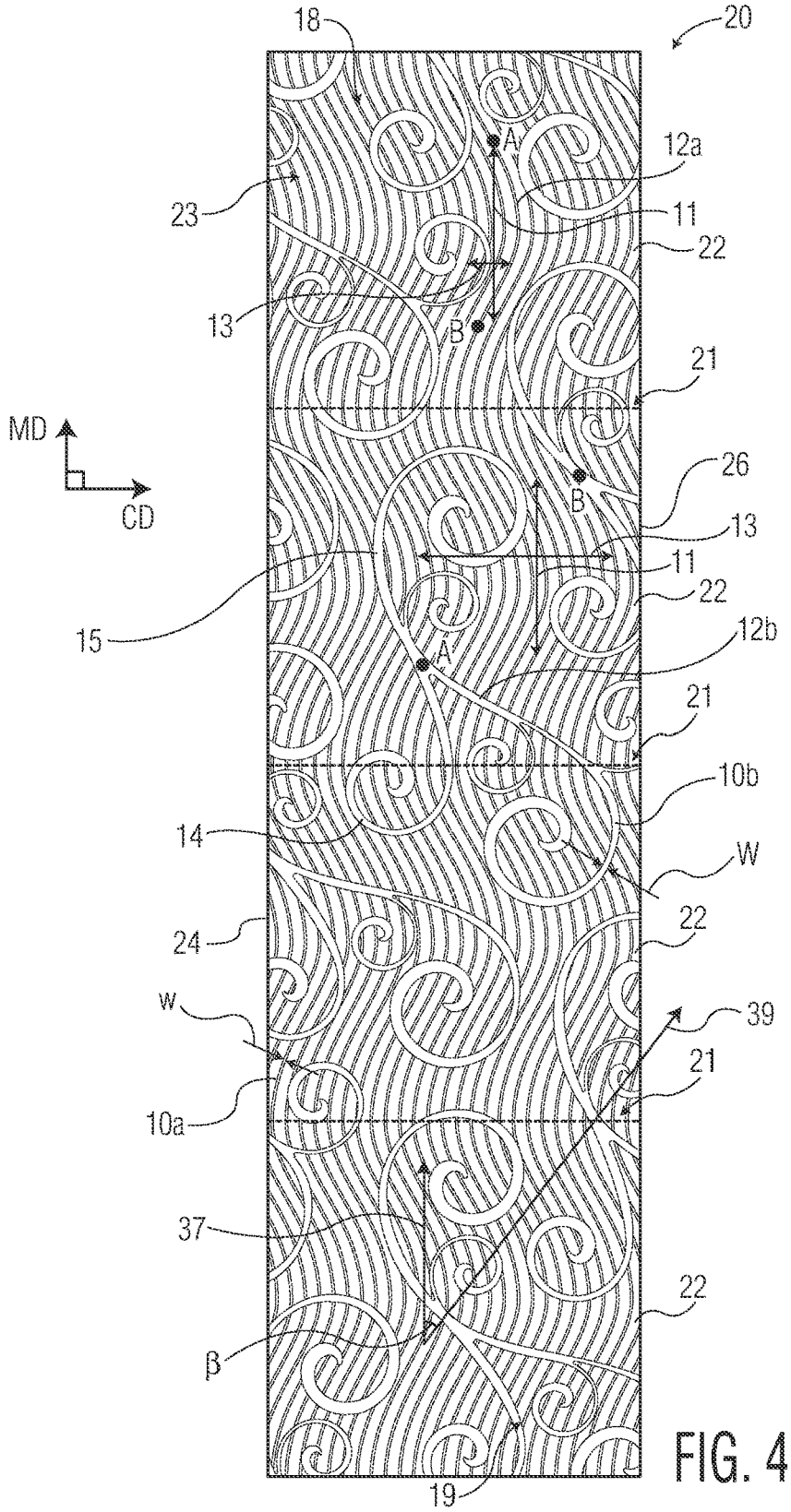
FIG. 4 illustrates a tissue product comprising first and second curvilinear design elements according to another embodiment of the present invention.

As used herein the term "Discrete" when referring to an element disposed on the surface of a tissue product, such as a line element, a design element or a pattern, means that the element is visually unconnected from other elements and does not extend continuously in any dimension of the tissue product surface. A non-limiting example of a discrete design element is illustrated in FIG. 4 where the second pattern 19 comprises discrete curvilinear design elements 12*b*.

As used herein the term "Curvilinear Line Element" refers to any curved line element having at least one inflection point. Various non-limiting examples of curvilinear elements are illustrated in FIGS. 1A-D. A curvilinear line element need not be a continuous line, but rather may comprise discrete dots, dashes or line segments that are substantially connected visually. For example, with reference to FIG. 1B, the curvilinear line element 10 is formed from discrete lines separated from one another by line breaks 17. Despite the line breaks 17 the curvilinear line element 10 has the appearance of being substantially connected.

Curvilinear line elements may be used to form one or more design elements according to the present invention. In certain embodiments a design element may be formed from a single curvilinear line element or by a pair of spaced apart line elements.

As used herein the term "MD Segment Length" generally refers to the distance in the machine direction between two adjacent inflection points within a single curvilinear line element having two or more inflection points. Where a curvilinear line element has only a single inflection point, the MD segment length is measured in the machine direction between the inflection points of adjacent curvilinear design elements within a motif where the motif comprises more than one curvilinear design element or between the inflection points of curvilinear design elements in adjacent motifs where the motif comprises only a single curvilinear design element. For example, with reference to FIG. 1C, the curvilinear design element 12 is a curvilinear line element having two inflection points A, B. The distance between points A and B, in the machine direction (MD), is the MD Segment Length 11.

As used herein the term "CD Segment Length" generally refers to the distance in the cross-machine direction between two adjacent inflection points within a single curvilinear design element having two or more inflection points. Where a curvilinear line element has only a single inflection point, the CD segment length is measured in the cross-machine direction between the inflection points of adjacent curvilinear design elements within a motif where the motif comprises more than one curvilinear design element or between the inflection points of curvilinear design elements in adjacent motifs where the motif comprises only a single curvilinear design element. For example, with reference to FIG. 1A, the design element 12 comprises curvilinear design element 12 having two inflection points A, B. The distance between points A and B, in the cross-machine direction (CD), is the CD Segment Length 13.

Figure 1A:
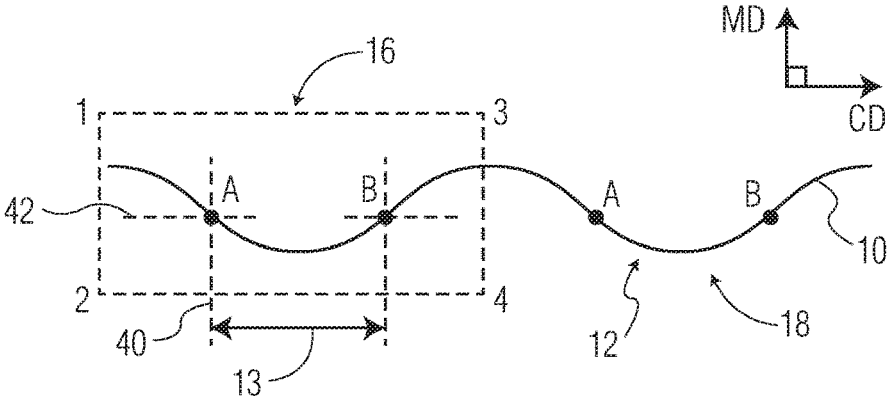
FIGS. 1A-1D illustrate various embodiments of curvilinear design elements useful in the present invention.
Figure 1B:
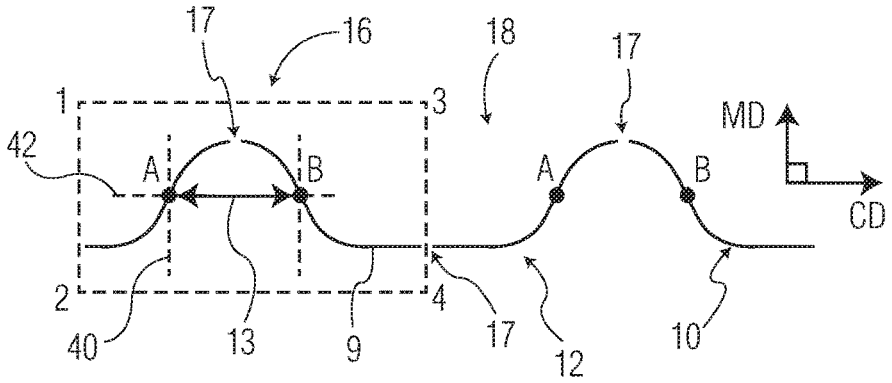
Figure 1C:
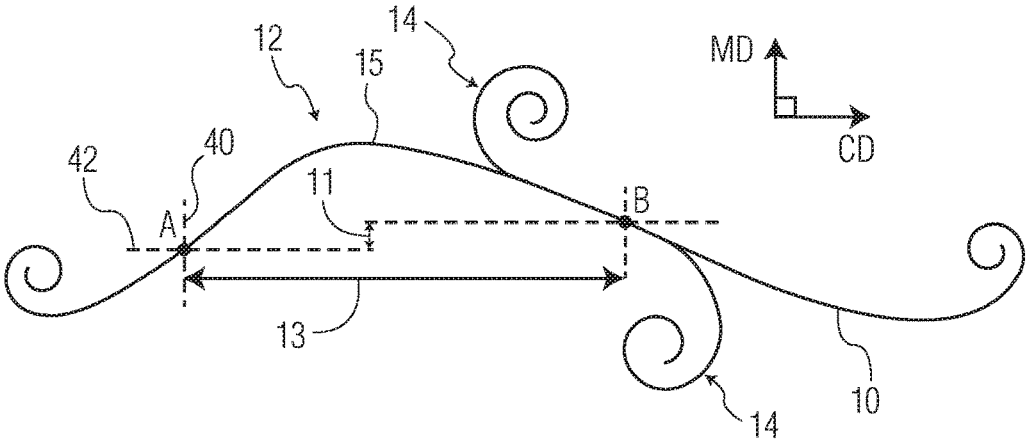
Figure 1D:
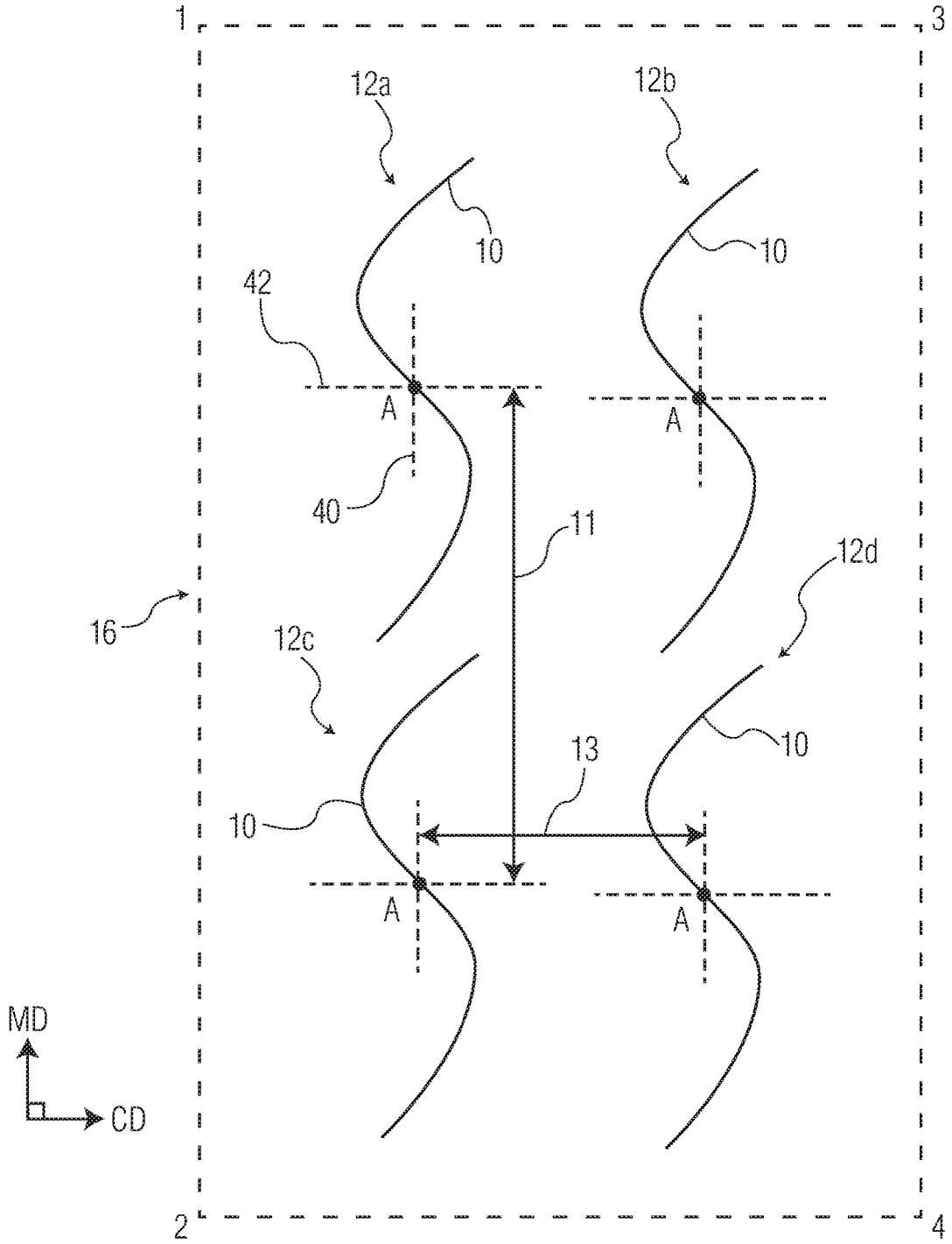

Measuring MD and CD segment length is further illustrated in FIG. 1D, where the motif 16 comprises four curvilinear design elements 12*a-d*, each having a single inflection point A. Because each of the curvilinear design elements 12*a-d* have only a single inflection point, the MD and CD segment lengths 11, 13 are measured between the inflection points of adjacent elements within the given motif.

As used herein the term "Maximum Segment Length" generally refers to the greatest MD or CD Segment Length for a given curvilinear design element or adjacent curvilinear design elements. For example, with reference to FIG. 1A, where the motif 16 comprises a curvilinear design element 12 having two inflection points A, B oriented in the MD and equally spaced apart in the CD provides a maximum segment length equal to the CD segment length 13. With reference to FIG. 1B, where the motif 16 comprises a bell shaped curvilinear design element 12 having two inflection points A, B and a linear portion 9 the maximum segment length is the CD segment length 13 between inflection points A and B. The CD segment length is not measured as the distance between inflection points A, B, as those points are between adjacent motifs rather than within a given motif. With reference to FIG. 1C where the curvilinear design element has two inflection points A, B and a CD segment length 13 greater than the MD segment length 11, the maximum segment length is equal to the CD segment length. Finally, with reference to FIG. 1D, the motif 16 comprises four discrete curvilinear design elements 12*a-d* having a single inflection point A, the maximum segment length is equal to the MD segment length 11, which is greater than the CD segment length 13.

As used herein the term "Design Element" generally refers to a shape or combination of shapes that visually create a distinct component. A design element is a curvilinear design element where it is at least partially formed by a curvilinear line element. A design element may be continuous or discrete. It is not necessary that a design element form a recognizable shape. The design element may be textured having a z-directional elevation relative to the plane of the tissue product, such as protrusions or depressions formed either by wet molding or embossing the tissue product. In other embodiments the design element may not be textured and be formed by printing on the tissue product surface.

Figure 2B:
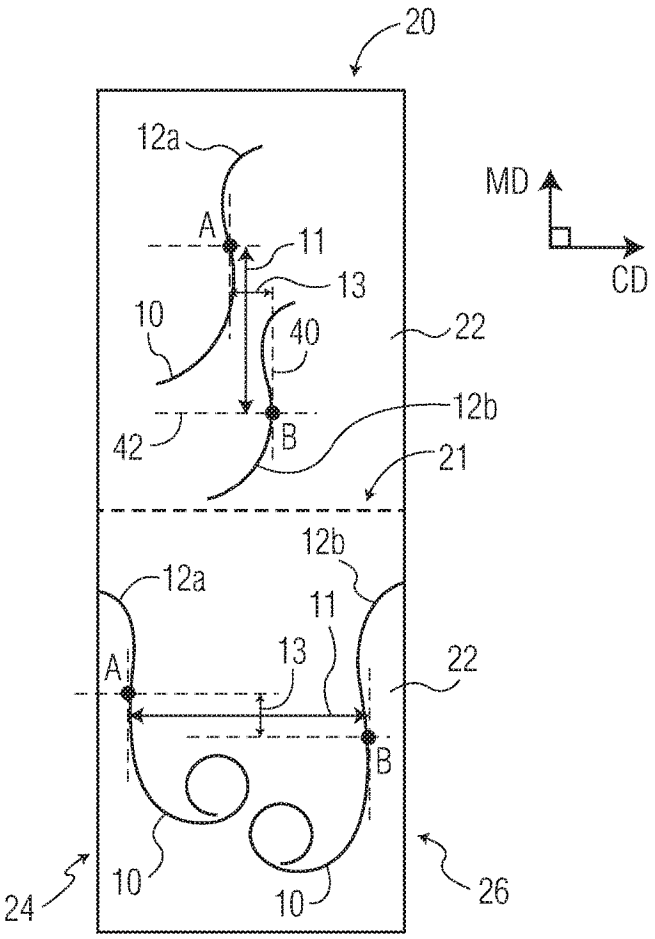
FIG. 2B illustrates a tissue product comprising two sheets having open curvilinear design elements disposed thereon.
Figure 2A:
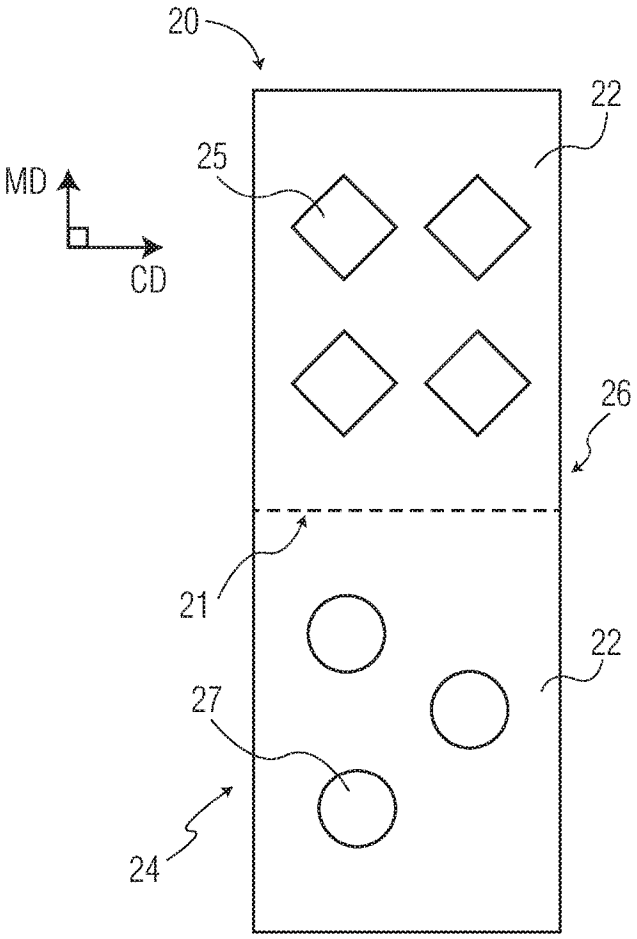
FIG. 2A illustrates a tissue product comprising two sheets having closed design elements disposed thereon.

As used herein the term "Closed Design Element" generally refers the appearance of a design element on a given sheet where the design element has no beginning or end within the given sheet. Examples of various closed design elements 25, 27 are illustrated in FIG. 2A. In each instance the closed design elements 25, 27 have no beginning or end within the given sheet 22.

As used herein the term "Open Design Element" generally refers the appearance of a design element of a given sheet where the design element has a beginning or end within the given sheet. Examples of various open curvilinear design elements 12*a*, 12*b* are illustrated in FIG. 2B.

As used herein the term "Pattern" generally refers to the arrangement of one or more design elements. Within a given pattern the design elements may be the same or may be different, further the design elements may be the same relative size or may be different sizes. For example, in one embodiment, a single design element may be repeated in a pattern, but the size of the design element may be different from one design element to the next within the pattern.

As used herein the term "Motif" generally refers to the recurrence of one or more design elements within a pattern. The recurrence of the design element may not necessarily occur within a given sheet, for example, in certain embodiments the design element may be a continuous design element extending across two adjacent sheets separated from one another by a line of perforations. Motifs are generally non-random repeating units that form a pattern.

As used herein the term "Overlay" generally refers to a second design element covering one or more portions of a first design element, but not the entirety of the first design element, such that the covered portions of the first design element are not visible to a consumer.

As used herein the term "Tissue Web" refers to a fibrous structure provided in sheet form and being suitable for forming a tissue product.

As used herein, a "Tissue Product" generally refers to various paper products, such as facial tissue, bath tissue, paper towels, napkins, and the like. Normally, the basis weight of a tissue product of the present invention is less than about 80 grams per square meter (gsm), in some embodiments less than about 60 gsm, and in some embodiments from about 10 to about 60 gsm and more preferably from about 20 to about 50 gsm. Tissue products may comprise one, two, three or more plies.

As used herein the term "Sheet" generally refers to a discrete unit of a tissue product. For example, where the tissue product comprises a tissue web convolutedly wound upon itself about a core or without a core to form a rolled tissue product, a sheet generally has parallel lateral sides and spaced-apart lines of perforations that define discrete sheets.

As used herein the term "Embossed" generally refers to a tissue product that has been subjected to a process which passes one or more plies of the tissue product through a nip created by one or more embossed rolls having a design pattern disposed thereon. Embossed does not include creping, microcreping, printing or other processes that may impart a texture and/or decorative pattern to a fibrous structure.

As used herein the term "Line embossment" generally refers to an embossment that comprises a line element aspect ratio of greater than about 2:1, more preferably greater than about 5:1 and still more preferably greater than about 10:1.

As used herein the term "Dot embossment" generally refers to an embossment that exhibits an aspect ratio of about 1:1. Non-limiting examples of dot embossments are embossments that are shaped like circles, squares, rectangles (dashes) and/or triangles. A plurality of spaced apart dot embossments that are substantially visually connected may form a curvilinear design element.

DETAILED DESCRIPTION OF THE DISCLOSURE

The present invention generally relates to a tissue product having a first pattern and a second pattern where the first and second patterns both comprise a curvilinear design element. By forming both the first and the second patterns at least partially from curvilinear design elements, the overall shape and appearance of the patterns may be related to one another and provide the tissue product with an overall aesthetic that is desirable to a consumer.

In addition to at least partially forming the first and second patterns from curvilinear design elements, it may be advantageous to further relate the first and second patterns to one another by providing the curvilinear design elements with similar scale. For example, in another embodiment, the present invention provides a tissue product having a first pattern comprising a curvilinear design element having a first shape, such as a wave, with two points of inflection that define a segment length from about 30 to about 60 mm and a second pattern comprising a curvilinear design element having a second shape, such as a bell-shaped curve, with two points of inflection that define a segment length from about 30 to about 60 mm.

The first and second patterns may also be visually related to one another by forming the patterns with curvilinear line elements having related line weights. For example, where the first and second patterns are formed from curvilinear design elements consisting of a single curvilinear line element the patterns may be related to one another by using similar line widths to form the curvilinear elements.

By providing first and second patterns with similar curvilinear shapes, scale, and line weights the first and second patterns may appear complementary to one another and enhance the overall aesthetic of the tissue product, making it more visually appealing to consumers. Further, by relating the patterns in terms of shape, scale and line weight, the overall design connotations such as femininity, softness and cleansing are enhanced.

Connotations of femininity, softness and cleansing are at least partially conveyed by forming the first and second design elements at least partially from curvilinear elements. The present inventors have discovered that curvilinear design elements are well suited for use in the present invention because they contain inflection points that connote femininity, softness and cleansing. Additionally, the use of curvilinear design elements provide for gradual transitions in contour within a pattern that may be soothing to a consumer and more easily balanced with other design elements. Further, the use of curvilinear design elements enables the formation of open design elements that provide the resulting patterns with a sense of continuity and balance that is visually appealing.

A wide breadth of curvilinear design elements may be selected from when developing patterns useful in the present invention. Further, although the patterns of the present invention are formed from curvilinear design elements, one skilled in the art will appreciate that a pattern may include shapes that are not curvilinear as well as lines and other shapes in addition to curvilinear elements.

Several non-limiting curvilinear design elements are illustrated in FIGS. 1A-D. For example, FIG. 1A illustrates a curvilinear design element 12 comprising a curvilinear line element 10 in the form of a wave. The motif 16 (circumscribed by the box 1234) is formed from repeated peaks and troughs, the transition between which defines two spaced apart inflection points A, B.

Another embodiment of a curvilinear design element is illustrated in FIG. 1B. The curvilinear design element 12 comprises a curvilinear line element 10 having a bell shape with linear elements 9 extending therefrom. The bell shaped curve forming the motif 16 (circumscribed by the box 1234) has two inflection points A, B. The motif 16 is repeated to form a pattern 18.

Still another embodiment of a curvilinear design element is illustrated in FIG. 1C. The curvilinear design element 12 comprises a curvilinear line element 10 having a central portion 15 with auxiliary line segments 14 extending therefrom. The central portion 15 has two inflection points A, B providing the design element 12 with a curvilinear shape. Generally the central portion of a design element refers to the longest continuous line segment of the element.

Yet another embodiment of a curvilinear design element is illustrated in FIG. 1D. The motif 16 (circumscribed by the box 1234) consists of four S-shaped design elements 12*a-d*. Each design element 12*a-d* comprises an S-shaped curvilinear line element 10 having a single inflection point A.

Surprisingly, by layering one curvilinear design element on top of another curvilinear design element the visual aesthetic and appeal of the resulting tissue product is enhanced. This is particularly true when both patterns comprise curvilinear design elements that relate to one another not only in their shape, but also in terms of scale and in certain embodiments in terms of line weight. Accordingly, in one embodiment, the present invention provides a patterned tissue product comprising a first pattern and a second pattern where both patterns comprise curvilinear design elements that relate to one another in both shape and scale. In other embodiments the present invention provides tissue products comprising a first pattern and a second pattern where both patterns comprise curvilinear design elements that relate to one another in terms of shape, scale and line weight.

In addition to the patterns being formed at least partially by curvilinear design elements, the first and second patterns may be further related by providing design elements that are open and continuous. Accordingly, in a particularly preferred embodiment the present invention provides a patterned tissue product comprising a first pattern and a second pattern where both patterns comprise open and continuous curvilinear design elements.

In addition to first and second patterns comprising curvilinear design elements the inventive tissue products may also comprise design elements which are not curvilinear. For example, a pattern may comprise a curvilinear design element and a design element lacking an inflection point such as, for example, spirals or straight line elements.

Additionally, while in certain embodiments it may be preferred that a pattern comprise an open curvilinear design element, the pattern may also include closed design elements such as circles and the like. While non-curvilinear design elements and closed design elements may be incorporated into the inventive tissue products, it is generally desirable that they only be incorporated to the extent that they complement the curvilinear design elements and reinforce connotations of femininity, softness and cleansing.

Provided that consumers prefer tissue product patterns comprising curvilinear design elements it may be preferable to form patterned tissue products without the use of rectilinear elements. Rectilinear elements may be perceived as being sharp, dangerous and rough and as such may be avoided when forming patterns for use in tissue products according to the present invention. Thus, in certain embodiments, the first and second patterns do not contain rectilinear elements. For example the first and second patterns may consist essentially of curvilinear design elements and linear elements.

Not only is it preferred to relate the shape and appearance of the first and second patterns by employing a curvilinear design element for both patterns, it is generally preferable to relate the scale of the first and second patterns by relating the scale of the first and second curvilinear design elements. By relating the scale of the design elements, the patterns visually complement one another and provide an appealing visual aesthetic.

The relative scale of the curvilinear design elements forming the first and the second patterns may be related by their respective maximum segment lengths. That is, the maximum segment length of the first curvilinear design element relates to the maximum segment length of the second curvilinear design element. For example, where a tissue product comprises a first pattern comprising a first curvilinear design element having a first maximum segment length and a second pattern comprising a second curvilinear design element having a second maximum segment length, the second maximum segment length is at least about 50 percent of the first maximum segment length and more preferably at least about 60 percent and still more preferably at least about 75 percent of the first maximum segment length, such as from about 50 to about 100 percent and more preferably from about 60 to about 80 percent of the first maximum segment length.

In one particularly preferred embodiment the patterned tissue product of the present invention comprises a first curvilinear design element consisting essentially of a sinusoidal wave having a maximum segment length from about 10 to about 250 mm, more preferably from about 25 to about 100 mm and still more preferably from about 40 to about 60 mm. A second curvilinear design element overlays the first design element. Preferably the shape of the second design element is different than the first design element. For example, the second design element may be S-shaped and have only a single point of inflection unlike the underlying first design element which is a continuous repeating wave where each repeated wave has two points of inflection. Alternately, the second design may be a discrete wave-like shape having two points of inflection. Regardless of the exact curvilinear shape of the second design element its scale relates to the first design element, such that the second curvilinear design element has a maximum segment length from about 10 to about 250 mm, more preferably from about 25 to about 100 mm and still more preferably from about 40 to about 60 mm.

While in certain embodiments the second curvilinear design element may have a maximum segment that is equal to, or less than, the maximum segment length of the first curvilinear design element, the invention is not so limited. In certain embodiments, particularly those where the first curvilinear design element is a continuous design element having two points of inflection and the second design element is discrete and has only a single point of inflection, the maximum segment length of the second curvilinear design element may exceed the maximum segment length of the first curvilinear design element. For example, the maximum segment length of the second curvilinear design element may be about 110 to about 200 percent of the length of the maximum segment length of the first curvilinear design element and more preferably from about 110 to about 150 percent of the length of the maximum segment length of the first curvilinear design element.

In addition to shape and scale, the first and second patterns may be related to one another in terms of line weight. That is, the curvilinear line elements forming the first and the second curvilinear design elements may have widths and spacing that visually relate the design elements to one another. For example, the first curvilinear design element may be formed by a pair of spaced apart curvilinear line elements. The line elements may be spaced apart from about 1.0 to about 10 mm, such as from about 2.0 to about 8.0 mm and more preferably from about 3.0 to about 6.0 mm. The foregoing line spacing generally refers to the maximum spacing between the line elements forming the design, as in certain embodiments the line elements may converge to form a design element. The line elements themselves may have a width from about 100 to about 2,000 μm, such as from about 300 to about 1,500 μm and more preferably from about 500 to about 1,000 μm.

The curvilinear line elements forming the second curvilinear design element may relate to the line elements of the first design element by having similar line spacing and widths. For example, the width of the line elements forming the second design element may be from about 100 to about 2,000 μm, such as from about 300 to about 1,500 μm and more preferably from about 500 to about 1,000 μm. In other embodiments the width of the line forming the second design element may be a certain percentage of the first, such as from about 75 about 100 percent of the line width forming the first design element, and more preferably from about 80 to about 100 percent. The spacing of the line elements forming the second curvilinear design element may also relate to the first curvilinear design element such as lines spaced apart from about 1.0 to about 10 mm, such as from about 2.0 to about 8.0 mm and more preferably from about 3.0 to about 6.0 mm.

One non-limiting example of a tissue product having two patterns that relate in terms of shape, scale and line weight is illustrated in FIG. 3. The illustrated tissue product 20 comprises opposed lateral edges 24, 26 and a horizontal line of perforations 21 separating the product into two sheets 22*a*, 22*b*. The tissue product has two principle axes of orientation—the machine direction (MD) and the cross-machine direction (CD). The tissue product 20 comprises a first pattern 18, also referred to as a background pattern, comprising a curvilinear line element 10 in the form of a sinusoidal wave having a first principle orientation, which is generally in the MD. The first pattern comprises a regular repeating motif 16*a* bounded by the box 1234. The motif 16*a*, shown in detail in FIG. 3A, has two points of inflection A, B. The distance between A and B in the MD defines a MD segment length 11. As the first pattern 18 is skewed by a slight angle (γ) relative to the MD axis 40, the inflection points A, B are not vertically aligned in the MD, but rather offset from one another a distance equal to the CD segment length 13.

While the orientation of the first pattern relative to the MD is non-limiting, in certain embodiments it may be preferred to have an angle (γ) greater than 0, particularly where the first pattern is imparted by embossing. For example, it is known in the art that if embossing patterns were aligned vertically or horizontally, the concentration of elements in one location could cause the emboss roll to wear in that area. Likewise, embossing rolls are often used in conjunction with backing surfaces or the like to create a nip. If patterns are aligned vertically or horizontally, there may be fluctuations in the concentration of embossing elements at the nip causing vibrations. To resolve these issues, manufacturers often skew their embossing patterns on the embossing roll. Thus, in certain embodiments the first pattern 18 may have a first principle orientation 37, which is at a skew angle (γ) relative to the MD axis 40 less than about 20 degrees, such as from about 5 to about 20 degrees and more preferably from about 8 to about 12 degrees.

Overlaying the first pattern 18 is a second pattern 19, also referred to as the foreground pattern. The second pattern 19 comprises a curvilinear line element 12*b* in the form of an S-shaped CD oriented line element. The pattern comprises regular repeating motifs 16*a*, 16*b*, two of which are bounded by the box 5678 and shown in detail in FIG. 3B. Two curvilinear elements 12*a*, 12*b* are illustrated, each having a single inflection point A and B. As each curvilinear element 12*a*, 12*b* has only a single inflection point A or B, the MD and CD segment lengths 11, 13 are measured between adjacent elements. Here, the MD and CD segment lengths 11, 13 are both greater than zero as the second pattern is oriented in the CD, but slightly skewed towards the MD. The orientation of the second pattern is non-limiting and one skilled in the art will appreciate that the second pattern may be oriented substantially in the CD such that the MD segment length is essentially zero.

Further, while the curvilinear line elements forming the curvilinear design elements that comprise the first and the second patterns are illustrated as being continuous and unbroken, the invention is not so limited. Rather, the line elements may include breaks or be made of discrete dots or dashes that, from a visual perspective, appear to be a continuous unbroken line. Thus, despite the breaks, a person is able to mentally complete the shape so as to perceive a broken line element as a continuous line element.

Figure 3A:
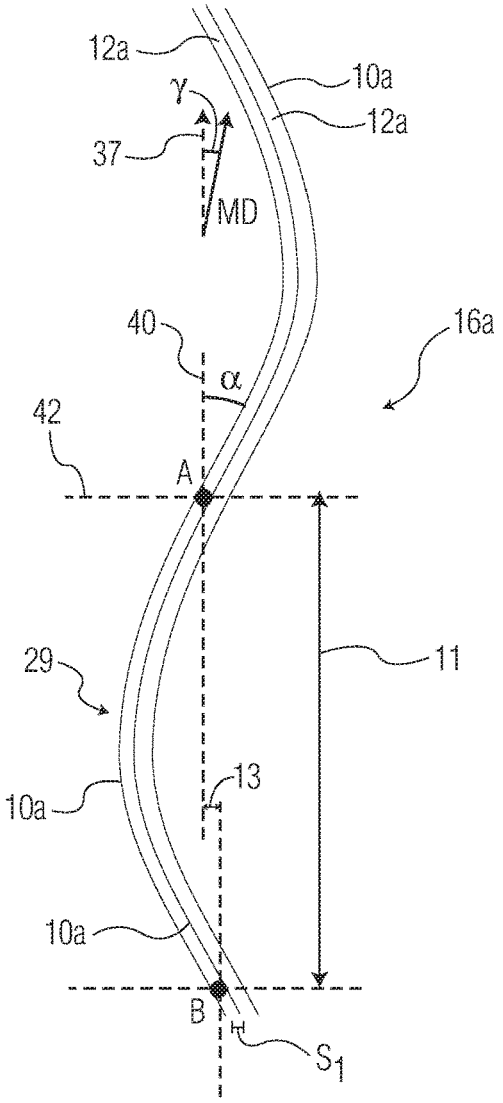
FIG. 3A is a detail view of the first curvilinear line element of FIG. 3.
Figure 3B:
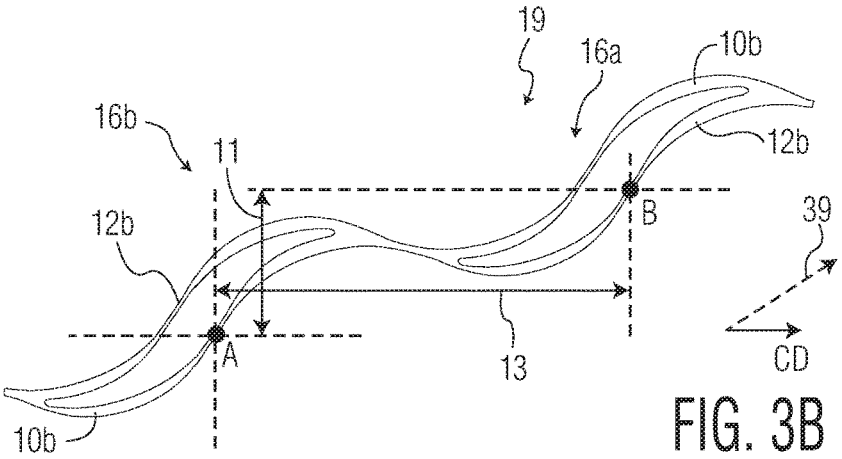
FIG. 3B is a detail view of the second curvilinear line element of FIG. 3.

With continued reference to FIGS. 3A and 3B, the MD and CD segment lengths 11, 13 are related to one another through the shape of the line elements 10*a*, 10*b* used to form the patterns. Both line elements 10*a*, 10*b* are curvilinear and form regular repeating motifs 16 that form the first and second patterns 18, 19. The visual relationship between the patterns 18, 19 is further enhanced by the fact that both patterns are formed from open curvilinear design elements and that the patterns are continuous.

The relative scale of the first and the second curvilinear design elements 12*a*, 12*b* further enhances their visual relationship. The maximum segment length (equal to the MD segment length 11) of the first curvilinear design element 12*a* may be from about 10 to about 100 mm, more preferably from about 30 to about 60 mm and still more preferably from about 40 to about 50 mm. The maximum segment length (equal to the CD segment length 13) of the second curvilinear design element 12*b* may be less than, equal to, or greater than the first maximum segment length, such as from about 10 to about 100 mm, more preferably from about 30 to about 60 mm and still more preferably from about 40 to about 50 mm.

Finally, the first and the second curvilinear design elements 12*a*, 12*b* are related to one another by the widths (W) of the elements and the lines 10*a*, 10*b* forming the elements. For example the width (W) of the lines 10*a*, 10*b* and may range from about 0.5 to about 5.0 mm, such as from about 0.75 to about 3.0 mm and more preferably from about 0.9 to about 1.5 mm.

In one embodiment, at the foregoing spacing and widths, a tissue product of the present invention may comprise a pattern formed from a sinusoidal wave where the pattern comprises from about 2.0 to about 4.0 curvilinear design elements per centimeter in the cross-machine direction, more preferably from about 2.2 to about 3.5 line elements per centimeter and still more preferably from about 2.4 to about 3.0 line elements per centimeter.

With reference now to FIG. 4, another embodiment of a tissue product 20 having a first pattern 18 overlaid by a second pattern 19 is illustrated. The first pattern 18 is a wave-like topographical pattern disposed on the surface 23 of the tissue product 20. The wave-like topographical pattern 18 comprises a plurality of substantially MD oriented continuous line elements 10 separated from one another by the planar surface 23 of the tissue product 20. The line elements 10 are arranged generally parallel to one another such that no two line elements intersect one another. While the first pattern 18 is illustrated as a continuous wave-like topographical pattern, in other embodiments the pattern may be semi-continuous or discontinuous.

The first pattern 18 comprises a regular repeating motif comprising a curvilinear design element 12*a* having two inflection points A, B. The distance between A and B in the MD and CD defines a MD segment length 11 and a CD segment length 13. As the first pattern 18 is substantially aligned in the MD, the distance between the inflection points A, B is greater in the MD than the CD to yield a first maximum segment length equal to the MD segment length 11. The first maximum segment length may be from about 10 to about 100 mm, more preferably from about 30 to about 60 mm and still more preferably from about 40 to about 50 mm.

The first pattern may be a continuous pattern that repeatedly crosses the MD axis to define an element angle (α). In the case of patterns having a wave-like shape such as illustrated in FIG. 4 the element angle (α) is generally the inverse tangent of the amplitude over half the wavelength. For other element shapes, such as continuous and discontinuous curvilinear elements the element angle (α) may simply be measured relative to the MD axis. Preferably the element angle (α) is less than about 20 degrees, such as from about 1 to about 20 degrees and more preferably from about 5 to about 15 degrees and still more preferably from about 8 to about 12 degrees.

With reference again to the non-limiting example illustrated in FIG. 4, the first pattern 18 comprises a first curvilinear design element 12*a* and overlays the second pattern 19, which comprises a second curvilinear design element 12*b*. The second curvilinear design element 12*b* is a paisley-like shape having a single point of inflection (two different inflection points illustrated as A and B). The paisley-like shape comprises a central portion 15 and a plurality of auxiliary line elements 14. As the curvilinear line element 12*b* has a single inflection point, the maximum segment length is measured between adjacent elements within a motif. Here, the distance is measured between inflection points A and B where the design elements are spaced apart from one another in both the MD and CD. The MD and CD segment lengths 11, 13 may range from about 10 to about 100 mm, more preferably from about 30 to about 60 mm, and still more preferably from about 40 to about 50 mm. In the illustrated embodiment the CD segment length 13 is greater than the MD segment length 11 and defines the second maximum segment length, which may be from about 50 to about 150 percent of the first maximum segment length, more preferably from about 75 to about 125 percent of the first maximum segment length and still more preferably from about 80 to about 110 percent of first maximum segment length.

The first pattern 18 is continuous and extends in a first principle direction 37. The second pattern 19 is discrete and extends in a second principle direction 39. As such the second pattern 19 is arranged at an angle (β) relative to the first pattern 18, where the angle (β) may be from about 10 to about 60 degrees, such as from about 15 to about 45 degrees and more preferably from about 20 to about 30 degrees. Additionally, the continuous first pattern 18 extends across the entire surface 23 of the tissue product 20. In other embodiments the first pattern may be continuous and extend across only a portion of the tissue product surface, such as from about 50 to about 90 percent of the tissue product surface.

As further illustrated in FIG. 4, in addition to be related through shape and scale, the first and second design elements 12*a*, 12*b* may be related through the weight of the line elements 10*a*, 12*b* forming the design elements. For example, the first and second curvilinear design elements 12*a*, 12*b* may be formed from curvilinear line elements 10*a*, 10*b* having line widths (W) from about 0.5 to about 5.0 mm, such as from about 0.75 to about 3.0 mm and more preferably from about 0.9 to about 1.5 mm. The line elements may be spaced apart from one another to form design elements having a width from about 1.0 to about 10 mm, such as from about 2.0 to about 5.0 mm and more preferably from about 3.0 to about 4.5 mm.

Figure 5:
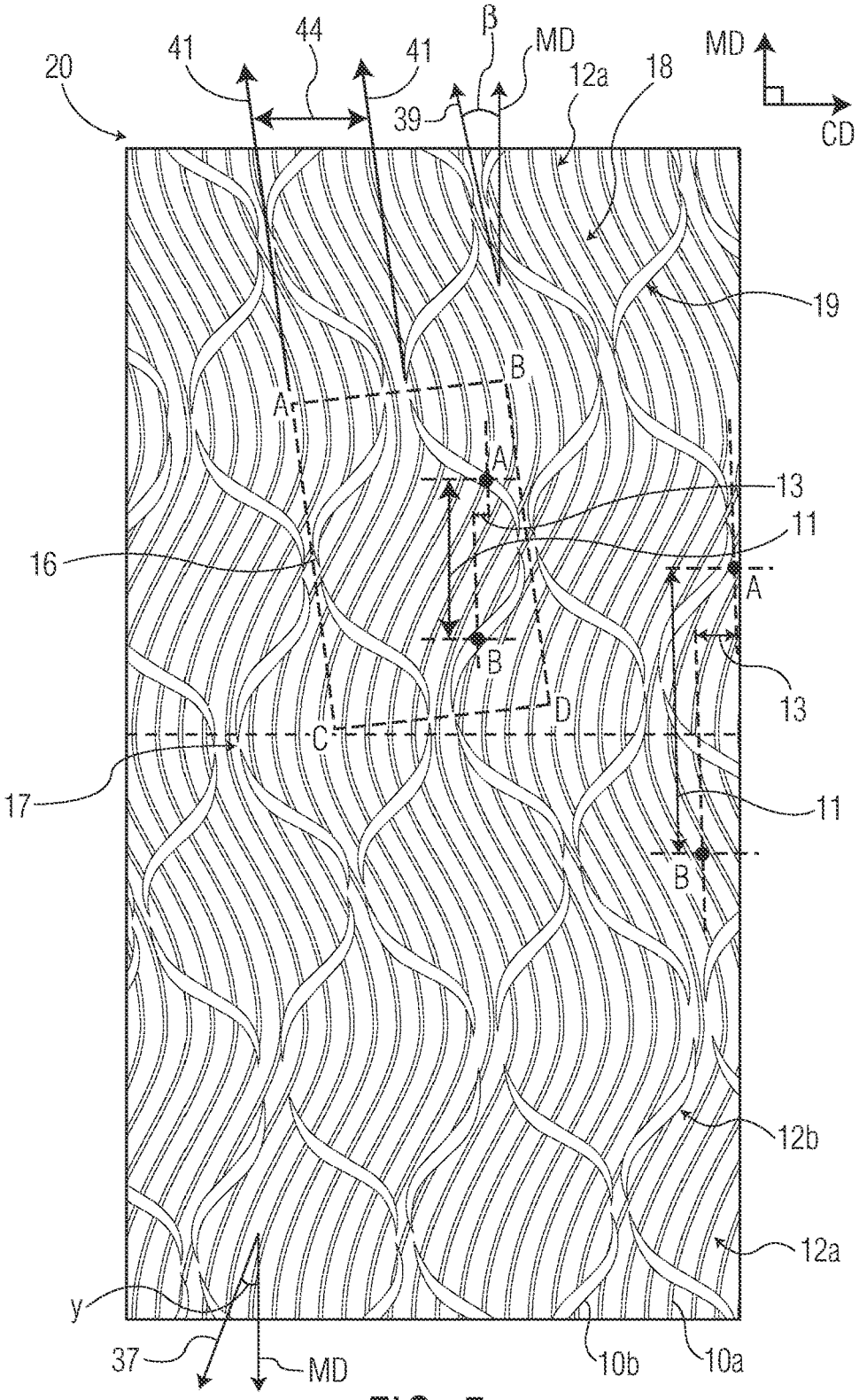
FIG. 5 illustrates a tissue product comprising first and second curvilinear design elements according to yet another embodiment of the present invention.

In other embodiments, such as that illustrated in FIG. 5 the first and second patterns 18, 19 may be oriented in the MD direction and relate to one another in terms of shape, scale and line weight. As shown in FIG. 5, the first pattern 18 comprises a first curvilinear design element 12*a* in the form of a sinusoidal wave similar to those illustrated in FIGS. 3 and 4 and described in detail above. The first pattern 18 has a first principle direction 37, which is skewed slightly by angle (γ) relative to the MD axis. The second pattern 19 overlays the first pattern 18 and comprises second curvilinear design element 12*b*, which is generally bell-shaped. The motif 16 of the second pattern 19 is circumscribed by the box ABCD. The second pattern 19 has an axis of symmetry 41, which provides the pattern with a second principle orientation 39, which is oriented at an angle (β) relative to the first principle orientation 37. In certain embodiments the angle (β) may be from about 5 to about 60 degrees, such as from about 10 to about 50 degrees and more preferably from about 15 to about 30 degrees.

With further reference to FIG. 5, the second pattern 19 has an axis of symmetry 41. In this manner the spacing 44 between adjacent motifs may be measured with reference to the adjacent pattern's axis of symmetry 41. In certain embodiments the tissue product may comprise a pattern having motifs spaced apart from one another continuously throughout the surface of the product where adjacent motifs are spaced apart from one another by at least about 10 mm, such as from about 10 to about 50 mm and more preferably from about 20 to about 30 mm.

Tissue webs useful in forming the patterned tissue products of the present invention may be formed using any one of several well-known manufacturing processes. For example, in certain embodiments, fibrous structures may be produced by a through-air drying (TAD) manufacturing process, an advanced tissue molding system (ATMOS) manufacturing process, a structured tissue technology (STT) manufacturing process, or belt creped. In particularly preferred embodiments the fibrous structure is manufactured by a creped through-air dried (CTAD) process or uncreped through-air dried (UCTAD) process.

Tissue webs produced by the foregoing processes may be imparted with a first pattern by wet molding. For example, one or more design elements may be formed by wet molding the web during manufacture using a patterned papermaking fabric, such as a patterned through-air drying fabric which imparts the pattern on the tissue web as it is dried. The second pattern may then be imparted by subjecting the patterned tissue product to embossing. For example, the patterned tissue web may be passed through a nip created by a pattern roll bearing a mirror image of the pattern and a backing roll. As the web passes through the nip the web is compressed and the second pattern is imparted on the surface of the tissue web.

The foregoing processes of forming the first and second patterns are non-limiting and one skilled in the art will appreciate that the patterns may be imparted on the web using a variety of methods or combinations of methods. For example, the first and second patterns may both be formed by embossing or they may both be formed by wet-molding, or a combination of embossing and wet-molding.

In one embodiment, tissue webs useful in the present invention are formed by the UCTAD process of: (a) depositing an aqueous suspension of papermaking fibers (furnish) onto an endless forming fabric to form a wet web; (b) at least partially dewatering the wet web; (c) transferring the partially dewatered web to a through-air drying fabric having a pattern thereon; (d) molding the web to the patterned through-air drying fabric to impart a first pattern on the web; (e) through-air-drying the web and (f) embossing the web to impart a second pattern on the web.

In certain embodiments the process of imparting the tissue product with a pattern according to the present invention may result in a product having a surface pattern that is textured. For example, the first pattern may comprise spaced apart curvilinear line elements having a first elevation and a curvilinear design element defined by the spaced apart line elements having a second elevation. The second elevation may be defined generally by the upper planar surface of the tissue product. The z-directional elevation difference between the line elements and the design element may be at least about 100 μm, such as from about 100 to about 1,000 μm, more preferably from about 200 to about 800 μm and still more preferably from about 300 to about 500 μm. The z-directional elevation difference may be measured using a VHX-1000 Digital Microscope equipped with VHX-H3M application software (Keyence Corporation of Osaka, Japan).

While tissue webs, and tissue products comprising the same, have been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto and the foregoing embodiments:

In a first embodiment the present invention provides a patterned tissue product comprising a first surface with a first and a second pattern disposed thereon, the first pattern comprising a curvilinear design element having a first maximum segment length and the second pattern comprising curvilinear design element having a second maximum segment length wherein the second maximum segment length is from about 50 to about 150 percent of the first maximum segment length.

In a second embodiment the present invention provides the tissue product of the first embodiment wherein the second pattern overlays the first pattern.

In a third embodiment the present invention provides the tissue product of the first or the second embodiments wherein the first maximum segment length is greater than about 40 mm.

In a fourth embodiment the present invention provides the tissue product of any one of the first through the third embodiments wherein the first maximum segment length is from about 40 to about 60 mm and the second segment length is from about 50 to about 100 percent of the first maximum segment length.

In a fifth embodiment the present invention provides the tissue product of any one of the first through the fourth embodiments wherein the second maximum segment length is greater than the first maximum segment length.

In a sixth embodiment the present invention provides the tissue product of any one of the first through the fifth embodiments wherein the first pattern is continuous and comprises an open curvilinear design element and the second pattern is continuous and comprises an open curvilinear design element.

In a seventh embodiment the present invention provides the tissue product of any one of the first through the sixth embodiments wherein the first pattern comprises a plurality of parallel, substantially machine direction (MD) oriented, sinusoidal waves having maximum segment length from about 40 to about 60 mm.

In an eighth embodiment the present invention provides the tissue product of any one of the first through the seventh embodiments wherein the first pattern has a first principle direction and the second pattern has a second principle direction, the first and the second principle direction arranged relative to one another at an angle from about 15 to about 45 degrees.

In a ninth embodiment the present invention provides the tissue product of any one of the first through the eighth embodiments wherein the second pattern is formed from an open curvilinear design element consisting of two spaced apart curvilinear lines having a line width from about 0.5 to about 5.0 mm, such as from about 0.75 to about 3.0 mm and more preferably from about 0.9 to about 1.5 mm.

The line elements may be spaced apart from one another to form design elements having a width from about 1.0 to about 10 mm, such as from about 2.0 to about 5.0 mm and more preferably from about 3.0 to about 4.5 mm.

In a tenth embodiment the present invention provides the tissue product of any one of the first through the ninth embodiments wherein the second pattern is oriented on the surface of the tissue product at an angle of from about 20 to about 60 degrees relative to the machine direction.

What is claimed is:

1. A method of manufacturing a patterned tissue product comprising the steps of:

a. depositing an aqueous suspension of papermaking fibers onto an endless forming fabric to form a wet web;

b. at least partially dewatering the wet web;

c. transferring the partially dewatered web to a through-air drying fabric having a pattern disposed thereon;

d. molding the web to the patterned through-air drying fabric to impart a first pattern on the web, wherein the first pattern comprises a first curvilinear design element having a first maximum segment length and a first direction;

e. through-air-drying the web; and f. embossing the through-air-dried web to impart a second pattern on the web, wherein the second pattern comprises a curvilinear design element having a second maximum segment length and a second direct second direction that intersects the first direction and the second maximum segment length is from about 50 to about 150 percent of the first maximum segment length.

2. The method of claim 1 wherein the first pattern is continuous and the first direction is angled relative to the machine direction axis from about 15 to about 45 degrees.

3. The method of claim 1 wherein the curvilinear design element of the second pattern consists essentially of a line embossment having a width from about 0.5 to about 2.5 mm.

4. The method of claim 1 wherein the curvilinear design elements forming the first and the second patterns each have two points of inflection, but are differently shaped.

5. The method of claim 1 wherein the first and the second pattern are continuous.

6. The method of claim 1 wherein the first pattern is continuous and comprises parallel, spaced apart curvilinear line elements forming a curvilinear design element there between, and wherein the z-directional elevation difference between the line elements and the design element is greater than about 100 μm.

* * * * *